US010149527B2

(12) United States Patent
Thorez et al.

(10) Patent No.: US 10,149,527 B2
(45) Date of Patent: Dec. 11, 2018

(54) COVERING DEVICE FOR A CONTAINER, IN PARTICULAR A COSMETIC PRODUCT CONTAINER, AND CONTAINER COMPRISING SUCH A COVERING DEVICE

(71) Applicant: ALBEA SERVICES, Gennevilliers (FR)

(72) Inventors: Gael Thorez, Voisins-le-Bretonneux (FR); Philippe Paris, Ecommoy (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/323,733

(22) PCT Filed: Jul. 3, 2015

(86) PCT No.: PCT/EP2015/065263

§ 371 (c)(1),
(2) Date: Jan. 3, 2017

(87) PCT Pub. No.: WO2016/001434

PCT Pub. Date: Jan. 7, 2016

(65) Prior Publication Data

US 2017/0135458 A1 May 18, 2017

(30) Foreign Application Priority Data

Jul. 4, 2014 (FR) ..... 14 56473

(51) Int. Cl.

| | |
|---|---|
| ***A45D 34/02*** | (2006.01) |
| ***A45D 34/00*** | (2006.01) |
| ***B65D 23/14*** | (2006.01) |
| ***B05B 11/00*** | (2006.01) |
| ***B65D 43/02*** | (2006.01) |

(52) U.S. Cl.

CPC ..... *A45D 34/02* (2013.01); *A45D 34/00* (2013.01); *B05B 11/0008* (2013.01); *B05B 11/0097* (2013.01); *B05B 11/30* (2013.01); *B65D 23/14* (2013.01); *B65D 43/02* (2013.01); *A45D 2034/002* (2013.01); *A45D 2034/007* (2013.01); *A45D 2200/057* (2013.01)

(58) Field of Classification Search

CPC ..... A45D 34/00; A45D 34/02; B05B 11/008; B05B 11/0097

USPC ..... 222/182, 153.09, 321.7, 321.9, 383.1, 222/402.12

See application file for complete search history.

(56) References Cited

U.S. PATENT DOCUMENTS 5,489,047 A * 2/1996 Winder ..... B65D 83/262 222/325

7,575,132 B2 * 8/2009 Stuart ..... B05B 11/3015 222/383.1

(Continued)

*Primary Examiner* — Vishal Pancholi

(74) *Attorney, Agent, or Firm* — Steven M. Greenberg, Esq.; Shutts & Bowen LLP

(57) ABSTRACT

The invention relates to a covering device for a container (10), in particular a bottle intended to contain a cosmetic product, said device (1) comprising a decorative element (2) and a holding ring (5) that is able to be fixed to the container (10) by first fixing means and is also able to keep the decorative element (2) on the container (10) by way of second fixing means, said second fixing means being removable so as to allow said decorative element (2) to be mounted on and removed from said ring (5).

11 Claims, 3 Drawing Sheets

(56) References Cited

U.S. PATENT DOCUMENTS

Figure 1:
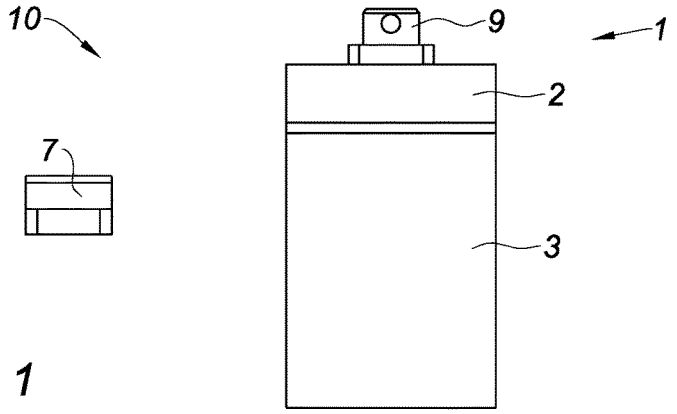

| | | | | |
|---|---|---|---|---|
| 7,874,465 | B2 * | 1/2011 | Bertin | B05B 11/0032 222/153.11 |
| 8,308,030 | B2 * | 11/2012 | Drugeon | A45D 34/02 215/272 |
| 8,695,852 | B2 * | 4/2014 | Bertin | B05B 11/0032 222/153.13 |
| 2006/0169355 | A1 | 8/2006 | Wong et al. | |
| 2008/0237268 | A1 | 10/2008 | Preteroti | |
| 2010/0089950 | A1 * | 4/2010 | Helf | B65D 83/206 222/153.09 |
| 2012/0199613 | A1 * | 8/2012 | Demarest | B65D 83/207 222/402.13 |

* cited by examiner

COVERING DEVICE FOR A CONTAINER, IN PARTICULAR A COSMETIC PRODUCT CONTAINER, AND CONTAINER COMPRISING SUCH A COVERING DEVICE

CROSS-REFERENCE TO RELATED APPLICATIONS

This application is a § 371 national phase entry of International Application No. PCT/EP2015/065263, filed Jul. 3, 2015, which claims priority to French Patent Application No. 1456473, filed Jul. 4, 2014.

The invention relates to a covering device for a container, in particular a bottle intended to contain a cosmetic product. This may in particular be a container comprising a pump able to spray said cosmetic product.

In the cosmetic field, the aesthetics of the containers play a key role in users purchasing decisions. Said cosmetic product containers must be attractive. Furthermore, these containers must have aesthetics that evolve with fashion. Perfume bottles, for example, are frequently renewed because they may go out of style. The ascetic creativity of the manufacturers of such containers is therefore significant.

The creators of cosmetic products thus seek to impart original shapes to these bottles, which generally have a glass vessel provided with a neck, and a pump arranged at the neck in order to spray the cosmetic product. However, to increase their creative capacity and the associated aesthetic effects, they add additional decorative elements to the bottles.

Thus, there are adaptable decorative elements on the bottle, for example bands, which are generally made from a plastic-type material in order to give them varied colors and shapes, and to inscribe product or brand names on them. The bands also serve to hide the less aesthetic parts of the bottle, such as the neck or the pump. In general, the bands also make it possible to hold a stopper covering the bottle when it is not in use.

Another very important aspect for consumers relates to refilling the bottles with cosmetic products, once the cosmetic product has been completely used and the bottle is empty. Indeed, consumers wish to be able to fill the bottle without having to purchase the whole item again, and thus to be able to save part of the cost, knowing that the original bottle has a significant impact on the sales price.

This results in the need to provide bottles whereof certain parts are removable to allow refilling of the vessel with cosmetic product. For example, in the case of a bottle with a pump, it is not only necessary to be able to remove the pump from the neck, but also the decorative elements nearby, such as the band that covers or surrounds the neck and the pump. Indeed, the pump is generally screwed on the neck, the pump comprising an inner tapping that cooperates with a thread arranged on the outer part of the neck. Thus, to be able to unscrew the pump, it is first necessary to remove the band.

Refillable bottles with a removable band exist, but the band and the pump are associated with one another permanently so as to unscrew them together when the bottle must be refilled. This forced association has repercussions on the shape of the band, which limit the aesthetic creativity. Furthermore, on the one hand, this has repercussions on the manufacturing cost of the bottle, and on the other hand, it is not possible to change the pump and the decorative element independently of one another.

Thus, there is currently no bottle having a band removable independently of the pump, particularly given that it is not possible to arrange two different threads on a same neck.

The invention therefore aims to obtain a covering device that makes it possible to improve the situation.

To that end, the invention relates to a covering device for a container, in particular a bottle intended to contain a cosmetic product, said device comprising a decorative element and a holding ring that is able to be fixed to the container by first fixing means and is also able to keep the decorative element on the container by way of second fixing means, said second fixing means being removable so as to allow said decorative element to be mounted on and removed from said ring.

Thus, the invention makes it possible to remove the decorative element, for example a band, independently of any other member, since the decorative element is connected only to the container, by means of the holding ring, whose sole function is to ensure removable fastening of the decorative element on the container. The device thus favors greater creative possibilities in the form and aesthetics of the decorative element.

In particular, the holding ring makes it possible to assemble the band to the bottle without the pump. It is also possible to change the pump or the decorative element independently of one another, as desired.

According to different embodiments of the invention, which may be considered together or separately:

- said first fixing means are configured to allow permanent catching on said container,
- the first fixing means include at least one snapping indentation arranged on the inner face of the holding ring, the snapping indentation being configured to be locked by a ring collar of the container to keep the holding ring on the container,
- alternatively, the ring collar is on the holding ring and the snapping indentation(s) are on the container,
- the first fixing means include at least one protuberance arranged on the inner face of the holding ring, said protuberance(s) being able to cooperate with a notch arranged on the container in order to prevent the holding ring from rotating on the container,
- the first fixing means include two opposite protuberances arranged on the inner face of the holding ring, the two protuberances being able to cooperate with two notches arranged on the container,
- the notch or notches are arranged on the ring collar,
- alternatively, the protuberance(s) are on the container ring and the notch or notches are on the holding ring,
- said holding ring has a circular profile, in particular a non-slotted profile,
- the second fixing means comprise at least one stud and at least one guide ramp, said guide ramp being able to cooperate with said stud to allow a fixing operation by rotating the decorative element on the holding ring,
- the second fixing means comprise two opposite studs and two opposite guide ramps,
- the guide ramp(s) include a narrowing allowing snapping of the stud at the end of the ramp when the decorative element is screwed on the holding ring,
- said stud(s) are arranged on a peripheral face of the ring and said guide ramp(s) are arranged on an inner face of the decorative element, or vice versa,
- the second fixing means comprise at least one end-of-travel stop arranged on an inner face of the decorative element and a ring collar arranged on the holding ring, the end-of-travel stop and the ring collar being able to cooperate so as to prevent rotation from continuing when they meet, the second fixing means comprise guide ribs arranged on an inner face of the decorative element, the guide ribs being able to rest on an upper rim of the ring to axially block and rotatably guide the decorative element on the holding ring, said ring collar(s) are situated at said guide ribs, said decorative element is formed from a single component having a decorative face resulting from molding with all or part of said second fixing means.

It should be noted that the rotating movement, here allowed by the implementation of the invention with a stud and guide ramp, is particularly advantageous in itself. Indeed, according to the known solutions, the fastening takes place following a translational movement, more specifically fitting, that may damage the parts in light of the forces that they undergo.

The invention thus also relates to a covering device for a container, in particular a bottle intended to contain a cosmetic product, said device comprising a decorative element and a holding ring that is able to be fixed to the container by first fixing means and is also able to keep the decorative element on the container by way of second fixing means, said second fixing means allowing catching of the decorative element on the holding ring by rotation, whether or not the decorative element is removable relative to the ring.

The invention also relates to a container, in particular for a cosmetic product, comprising the device described above.

According to different embodiments of the invention, which may be considered together or separately:

the container comprises a vessel, provided with a neck, and/or a pump, able to spray said cosmetic product, said pump is held removably on the vessel, in particular the neck, the container is provided with a single thread on the peripheral part of the neck, the thread being configured to allow the screwing of the pump, the decorative element is configured to hide the neck and/or at least part of said pump, the holding ring is fixed on the neck, the ring collar is arranged on the neck, the container is a bottle.

Figure 2:
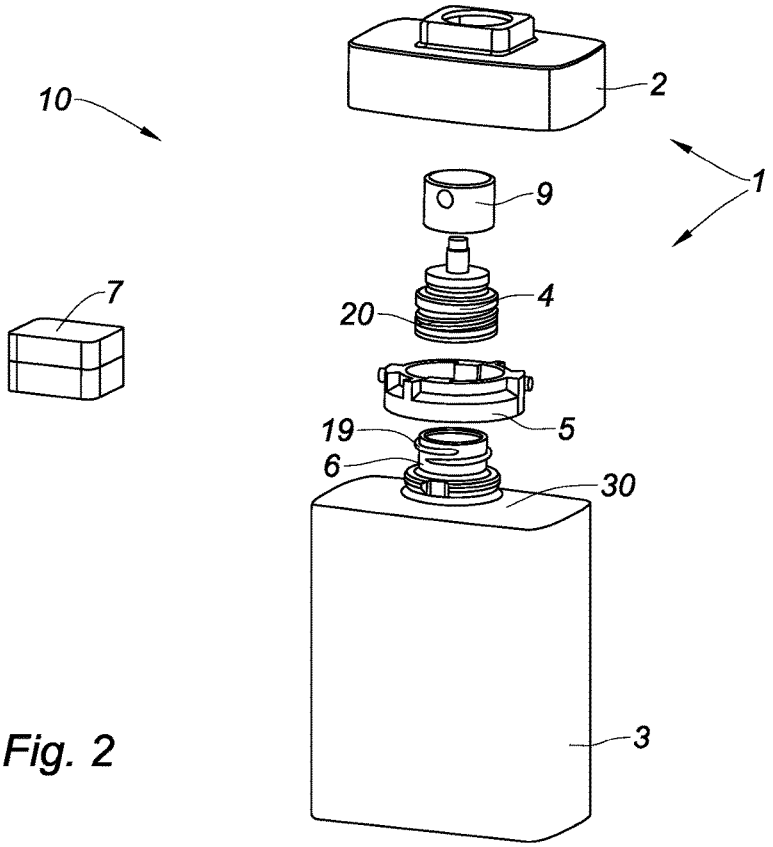
Figure 3:
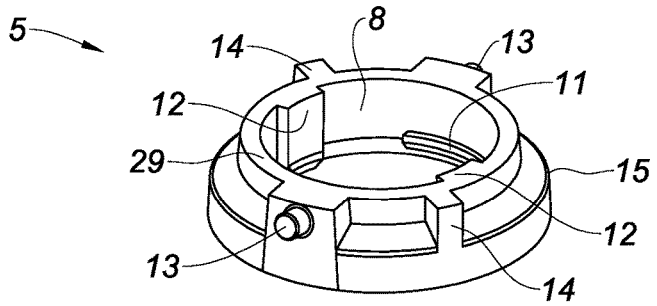
Figure 4:
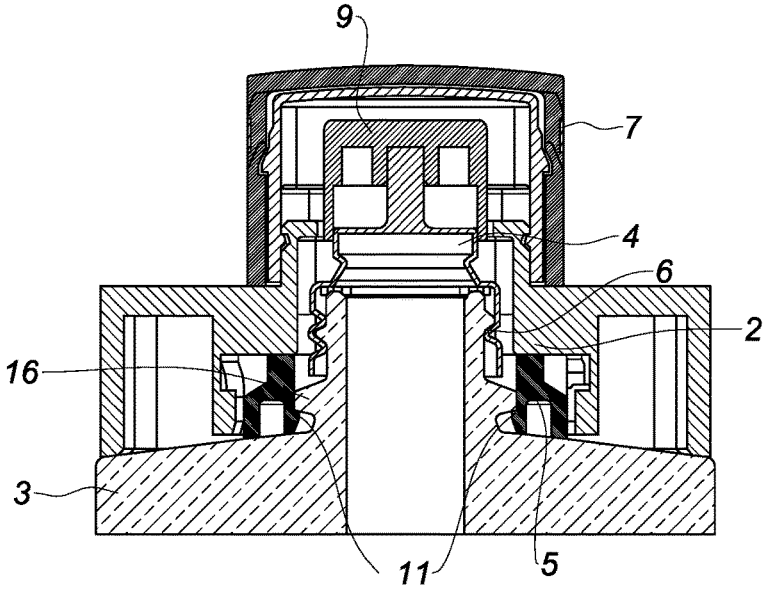
Figure 5:
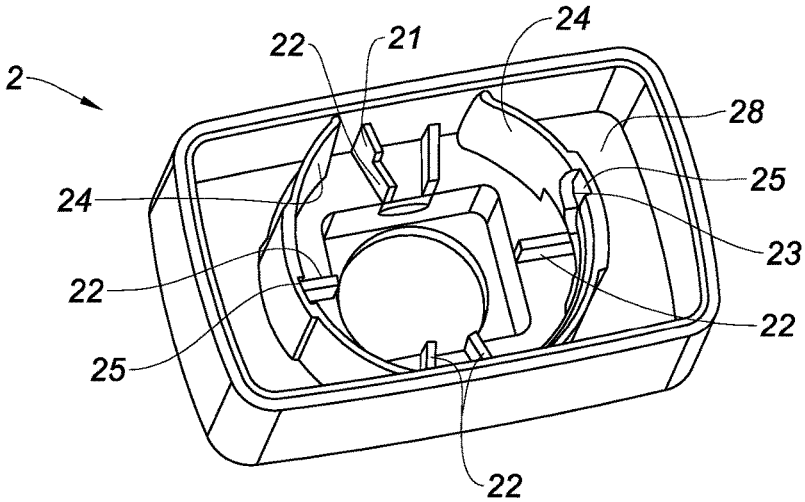
Figure 6:
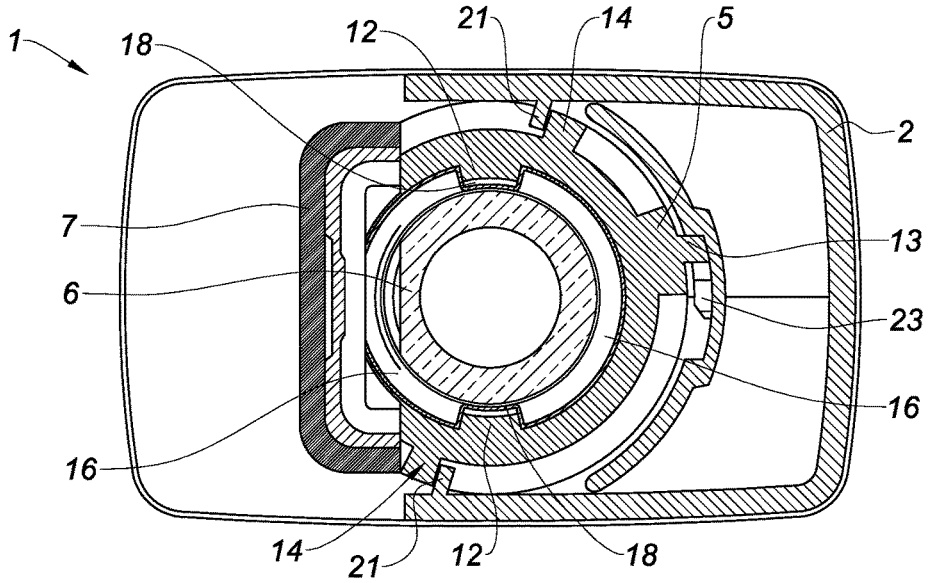
Figure 7:
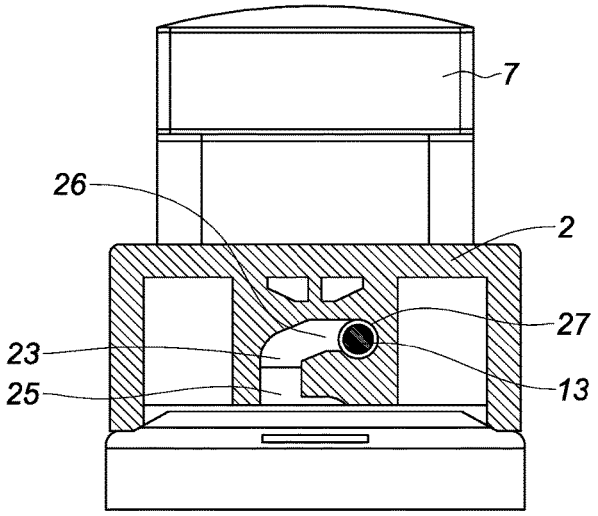

The invention will be better understood in light of the following description, which is provided solely for information and non-limitingly, accompanied by the attached drawings:

FIG. 1, diagrammatically illustrating a front view of a container provided with a covering device according to one embodiment of the invention, FIG. 2, diagrammatically illustrating a perspective view of said container, the elements of which are separated, FIG. 3, diagrammatically illustrating a perspective view of a holding ring of said covering device, FIG. 4, diagrammatically illustrating a front sectional view of the upper part of said container, FIG. 5, diagrammatically illustrating a bottom perspective view of the decorative element of said covering device, FIG. 6, diagrammatically illustrating a top sectional view of the upper part of said container, along cutting line A-A of FIG. 4, FIG. 7, diagrammatically illustrating a side sectional view of the upper part of said container.

The invention relates to a covering device 1 for a container, in particular a refillable container.

In FIGS. 1 and 2, the container is a bottle 10 intended to contain a cosmetic product of the perfume type. The bottle 10 comprises a glass vessel 3 provided with a neck 6, a pump 4 able to spray said cosmetic product, and a cover 7 making it possible to prevent unwanted actuation of the pump 4.

The pump 4 is connected to the vessel 3 while being held on the neck 6, such that it can suction the product contained inside the vessel 3, while serving as a stopper to preserve the product inside the vessel 3. The pump 4 is actuated using a plunger 9 accessible from outside the vessel 3 when the cover 7 has been removed. Thus, the pump 4 suctions the product through a conduit submerged in the bottom of the bottle, and sprays it through an orifice of the plunger 9.

To allow refilling of the product, the pump 4 is removably held on the neck 6. To that end, the vessel 3 is provided with a single thread 19 arranged on the peripheral part of the neck 6. The pump is provided with a corresponding tapping 20 on a fixing face, the neck 6 and the fixing face of the pump 4 having substantially cylindrical shapes to allow the pump 4 to be screwed on the neck 6.

The bottle 10 is further provided with a covering device 1 making it possible to hide the neck 6 and part of the pump 4, and to decorate the upper part of the bottle 10. The covering device 1 comprises a decorative element that rests on the upper face 30 of the vessel 3 comprising the neck 6. Here, the decorative element is a parallelepiped band 2 open on one face and comprising an inner face 28 that is found at a wall opposite the open face of the band 2. In other words, said band defines an inner volume accommodating the neck 6 and part of the pump 4. Said band 2 is provided with an orifice traversing said wall so that the plunger 9 forms an appendage outside the band 2 and thus allows the actuation of the pump 4. Said band 2 here comprises a boss allowing the fixing of the cover 7, said through orifice being situated at said boss.

In order to allow access to the pump 4 to unscrew it and refill the vessel 3 with product, the band 2 is removably maintained on the vessel 3. To that end, the covering device 1 comprises a holding ring 5 reversibly connecting the band 2 to the vessel 3. The holding ring 5 is fixed on the one hand to the neck 6 of the vessel 3 by first fixing means, and on the other hand to the band 2 by second fixing means. As shown in FIG. 3, the holding ring 5 is substantially ring-shaped with an inner face 8 intended to be substantially in contact with the neck, the inner face 8 substantially corresponding to the peripheral dimensions of the neck so as to surround it coaxially. The holding ring 5 also has a peripheral face 15 and an upper rim 29 intended to be substantially in contact with the band.

To ensure maintenance of the ring 5 on the vessel 3, the first fixing means are advantageously permanent. In other words, the holding ring 5 remains connected to the vessel 3 and is not meant to be removed with the band 2. Conversely, the second fixing means are removable so as to allow the band 2 to be assembled and disassembled, for example through a fastening operation by rotation around a longitudinal axis of said ring, which here corresponds to a longitudinal axis of the neck of the bottle 10. Thus, when the band 2 is removed from the bottle 10, the ring is separated from the holding ring 5, which remains attached to the vessel 3.

As shown in FIGS. 3 and 4, the first fixing means include at least one snapping indentation 11 arranged on the inner face 8 of the holding ring. When the ring 5 is assembled to the neck 6, the snapping indentation 11 is blocked by a ring collar 16 arranged on the neck 6. Here, the ring collar 16 is a coaxial annulus-shaped protuberance around the neck 6, which is made from the same material as the vessel 3, i.e., glass. The ring collar 16 is situated substantially at the base of the neck 6, and the snapping indentation 11 is situated substantially at the base of the holding ring 5, so as to be below the thread of the neck 6. The snapping indentation(s) 11 extend angularly, for example by about 90°.

In order to prevent the holding ring 5 from rotating, when the latter is fixed to the neck, the first fixing means include two opposite protuberances 12, arranged on the inner face 8 of the holding ring 5, as shown in FIGS. 3 and 6. Each protuberance is configured to be inserted into a notch 18 arranged on the vessel 3. Here, the two indentations 18 are formed in the ring collar 16 of the neck 6. More generally, it will be understood that the first fixing means may be configured to prevent the ring 5 from rotating on the bottle when the band 2 is fixed on or removed from the bottle 10.

The second fixing means here comprise two opposite studs 13 arranged on the peripheral face 15 of the holding ring 5 and two opposite guide ramps 23 arranged on the inner faces 24 of the band 2, as shown in FIGS. 3 and 5. Each guide ramp 23 cooperates with said stud 13 to allow a fixing or removal operation of the band 2 on the holding ring 5, like a bayonet fastener. The inner faces 24 of the band 2 extend axially from the inner face 28 of the band and have a substantially cylindrical shape so as to be able to surround the holding ring 5. They assume the form of partitions partitioning the inner volume of the band.

Thus, as shown in FIGS. 5 to 7, during the assembly of the band 2 on the ring 5, each stud 13 is inserted into a guide ramp 23 through an open end 25 of the guide ramp 23. Next, during the rotation of the band 2 on the ring 5, the stud 13 slides in the ramp 23 up to a closed end at the bottom 27 thereof.

In order to slightly lock the band 2 on the ring 5 to prevent unwanted movement during the use of the bottle 10, the guide ramps 23 are provided with a narrowing 26 allowing snapping of the stud 13 at the closed end 27 of the ramp 23. As shown in FIG. 7, the stud 13 is held between the closed end 27 of the ramp 23 and the narrowing 26 forming a boss inside the ramp 23. The boss is situated at a determined distance relative to the closed end 27 of the ramp 23, so as to jam the stud 13 against the closed end 27.

As shown in FIG. 5, to facilitate the assembly and disassembly of the band 2, the second fixing means here further comprise guide ribs 22 arranged on the inner face 28 of the band 2. Thus, the guide ribs 22 rest on the upper rim 29 of the ring 5 to position and guide the band 2 on the holding ring 5.

In order to mark the end of the rotation and avoid an additional rotation that would damage the stud 13, the second fixing means further advantageously include two end-of-travel stops 21 arranged on the inner face 28 of the band 2 and two corresponding ring collars 14 arranged on the peripheral face 15 of the holding ring 5, as shown in FIGS. 3 and 5.

An end-of-travel stop 21 and a ring collar 14 cooperate so as to prevent rotation from continuing when they meet. Indeed, as illustrated in FIG. 6, the end-of-travel stops 21 and the ring collars 14 are arranged so as to push one another back when the studs have reached the closed end of the guide ramp 23, at the end of rotation. In FIG. 5, the end-of-travel stops 21 each extend axially from a guide rib 22 of the band 2. In other words, here they are an axial extension of part of the guide rib 22 that does not rest on the rim of the ring when the band 2 and the ring are assembled. Here, this involves the most radially off-centered part of said guide ribs 22.

If one refers again to FIG. 3, one sees that the holding ring 5 here comprises a shoulder between an inner peripheral part provided with said upper edge 29 and an outer peripheral part forming a step extending angularly. Said ring collars 14 extend radially from said shoulder and axially from said outer peripheral part. Said stops 21 thus circulate angularly above said outer periphery part during the rotation of the band 2 relative to the ring 5.

Said studs 13 extend radially from said shoulder, past the outer peripheral part. In this way, they can cooperate with the guide ramp 22.

The invention claimed is:

1. A covering device for a container adapted to contain a cosmetic product, said device comprising a decorative element and a holding ring that is fixed to the container by first fixing means, and secures the decorative element on the container with second fixing means, said second fixing means being removable so as to allow said decorative element to be mounted on and removed from said ring, wherein the second fixing means comprise at least one stud arranged on a peripheral face of the holding ring and at least one guide ramp arranged on an inner face of the decorative element, said guide ramp cooperating with said stud to allow a fixing operation by rotating the decorative element on the holding ring.

2. The device according to claim 1, wherein said first fixing means are configured to allow permanent catching on said container.

3. The device according to claim 2, wherein the first fixing means include at least one snapping indentation arranged on an inner face of the holding ring, the snapping indentation being configured to be locked by a ring collar of the container to keep the holding ring on the container.

4. The device according to claim 1, wherein the first fixing means include at least one protuberance arranged on the inner face of the holding ring, said at least one protuberance cooperating with a notch arranged on the container in order to prevent the holding ring from rotating on the container.

5. The device according to claim 4, wherein the first fixing means include two opposite protuberances arranged on the inner face of the holding ring, the two protuberances cooperating with two notches arranged on the container.

6. The device according to claim 1, wherein the second fixing means comprise two opposite studs arranged on the peripheral face of the holding ring and two opposite guide ramps arranged on the inner faces of the decorative element.

7. The device according to claim 1, wherein the at least one guide ramp includes a narrowing allowing snapping of the stud at an end of the at least one guide ramp when the decorative element is screwed on the holding ring.

8. The device according to claim 1, wherein the second fixing means comprise at least one end-of-travel stop arranged on an inner face of the decorative element and a ring collar arranged on the holding ring, the at least one end-of-travel stop and the ring collar cooperating so as to prevent rotation from continuing when the the at least one end-of-travel stop and ring collar meet.

9. The device according to claim 1, wherein the second fixing means comprise guide ribs arranged on an inner face of the decorative element, the guide ribs being able to rest on an upper rim of the holding ring to axially block and rotatably guide the decorative element on the holding ring.

10. A container, in particular for a cosmetic product, comprising a covering device a decorative element and a holding ring that is fixed to the container by first fixing means, and secures the decorative element on the container with second fixing means, said second fixing means being removable so as to allow said decorative element to be mounted on and removed from said ring, wherein the second fixing means comprise at least one stud arranged on a peripheral face of the holding ring and at least one guide ramp arranged on an inner face of the decorative element, said guide ramp cooperating with said stud to allow a fixing operation by rotating the decorative element on the holding ring.

11. The container according to claim 10, further comprising a pump, wherein said decorative element at least partially conceals said pump.

* * * * *